US006749701B2

(12) United States Patent
Hiramatsu et al.

(10) Patent No.: US 6,749,701 B2
(45) Date of Patent: Jun. 15, 2004

(54) METHOD OF INHIBITING COLD-ROLLED STEEL SHEET EDGE CRACKING, AND METHOD OF PRODUCING THE STEEL SHEET

(75) Inventors: Naoto Hiramatsu, Tokuyama (JP); Kouki Tomimura, Houfu (JP); Seiichi Isozaki, Tokuyama (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 10/287,634

(22) Filed: Nov. 5, 2002

(65) Prior Publication Data

US 2003/0131910 A1 Jul. 17, 2003

Related U.S. Application Data

(62) Division of application No. 09/759,349, filed on Jan. 16, 2001, now Pat. No. 6,488,786.

(30) Foreign Application Priority Data

Jan. 21, 2000 (JP) ..... 2000-12579
Aug. 1, 2000 (JP) ..... 2000-233534

(51) Int. Cl.[7] ..... C21D 8/007
(52) U.S. Cl. ..... 148/610; 148/650; 148/651
(58) Field of Search ..... 148/610, 650, 148/651

(56) References Cited

U.S. PATENT DOCUMENTS 4,878,955 A * 11/1989 Hoshino et al. ..... 148/610
5,624,504 A 4/1997 Miyakusu et al.

FOREIGN PATENT DOCUMENTS

| | | | | |
|---|---|---|---|---|
| JP | 51-31085 | | 9/1976 | |
| JP | 362214132 | * | 9/1987 | ..... 148/610 |
| JP | 63-7338 | | 1/1988 | |
| JP | 7-157850 | | 6/1995 | |
| JP | 8-74006 | | 3/1996 | |
| JP | 409263912 A | | 10/1997 | |
| JP | 410237597 | * | 9/1998 | ..... C22C/38/00 |

* cited by examiner

*Primary Examiner*—Deborah Yee
(74) *Attorney, Agent, or Firm*—McDermott, Will & Emery

(57) ABSTRACT

A high-strength, high-toughness martensitic stainless steel sheet has a chemical composition comprising, in mass percent, more than 0.03 to 0.15% of C, 0.2–2.0% of Si, not more than 1.0% of Mn, not more than 0.06% of P, not more than 0.006% of S, 2.0–5.0% of Ni, 14.0–17.0% of Cr, more than 0.03 to 0.10% of N, 0.0010–0.0070% of B, and the balance of Fe and unavoidable impurities and has an A value of not less than −1.8, where A value=30(C+N)−1.5Si+0.5Mn+Ni−1.3Cr+11.8. The suitability of the steel sheet as a gasket material is enhanced by producing it to include not less than 85 vol % of martensite phase and to have a spring bending elastic limit $Kb_{0.1}$ after application of tensile strain of 0.1% of not less than 700 N/mm$^2$. Edge cracking during cold rolling is inhibited by conducting cold rolling after subjecting the hot-rolled sheet to 600–800° C.×10 hr or less intermediate annealing to impart a steel hardness of not greater than Hv 380.

6 Claims, 1 Drawing Sheet

METHOD OF INHIBITING COLD-ROLLED STEEL SHEET EDGE CRACKING, AND METHOD OF PRODUCING THE STEEL SHEET

This application is a divisional of application Ser. No. 09/759,349 filed Jan. 16, 2000 now U.S. Pat. No. 6,488,786 B2 issued Dec. 3, 2000.

BACKGROUND OF THE INVENTION

1. Field of the Invention

This invention relates to a high-strength, high-toughness martensitic stainless steel sheet suitable for use in various types of springs, metal gaskets, metal masks, flapper valves, steel belts and the like, a method of inhibiting cold-rolled steel sheet edge cracking during production thereof, and a method of producing the steel sheet.

2. Background Art

Stainless steels conventionally used in metal gaskets, metal masks, and other applications demanding high strength include the following:

(A) Stainless steels work-hardened by cold rolling austenitic stainless steels such as SUS301 and SUS304. Stainless steels of this type utilize the hardness of cold-rolling-induced martensite per se. The asbestos gaskets long used in automobile and motorcycle engines are currently being replaced by metal gaskets employing stainless steel of this type.

(B) Precipitation-hardened stainless steels as typified by SUS630. Stainless steels of this type are low in hardness and excellent in workability before aging and exhibit high hardness owing to precipitation hardening after aging. They are also characterized by high resistance to weld softening. Stainless steel of this type are therefore used extensively for springs and steel belts that require welding. The assignee has developed stainless steels of this type with improved toughness and torsional properties (Japanese Patent Publication JPA No.Hei 7-157850 (1995) and JPA No.Hei 8-74006 (1996)).

(C) Quench-hardened stainless steels having high strength in the annealed state or after skin-pass rolling at a reduction ratio of several percent. Stainless steels of this type achieve high strength by utilizing martensite formed during quenching from the temperature region of austenite phase, or austenite phase+ferrite phase, to normal room temperature. These stainless steels do not require expensive precipitation hardening elements and can be produced with relatively few production steps. They are therefore relatively inexpensive in terms of both raw material cost and production cost. Stainless steels of this type developed by the assignee include the low-carbon martensitic stainless steel for steel belts described in Japanese Patent Publication JPB No.Sho 51-31085 (1976) and the high-ductility, high-strength multiphase structure stainless steel with small in-plane anisotropy described in Japanese Patent Publication JPA No.Sho 63-7338 (1988).

These prior-art stainless steels have the following drawbacks:

The type (A) work-hardened stainless steels require considerably strong cold working in order to form the large amount of martensite needed to attain high-level strength and spring properties. Since martensite is not readily formed at high working temperature, moreover, the cold working must be conducted at low speed to avoid steel temperature increase. Productivity is therefore low. In addition, the amount of martensite generation induced by the working is very sensitive to the austenite stability of the steel. This means that just a slight shift in steel composition makes the amount of martensite generated deviate from the desired constant value, even under a constant amount of cold working. The properties of the product therefore tend to vary.

As explained further later, a stainless steel to be used for cylinder head gaskets, which require high air-tightness, needs superb spring property. Consider, for example, the spring bending elastic limit Kb of a type (A) stainless steel such as SUS301 or SUS304, even if the strength of the stainless steel is increased to a high level by cold working, the $Kb_{0.1}$ value after imparting a tensile strain of 0.1% is only about 650 $N/mm^2$ at best. Better spring property than this is hard to achieve. Aging is sometimes used for imparting outstanding spring property to a metastable austenitic stainless steel. It has been found, however, that in applications to cylinder gaskets and the like, whose bead portion may come under compressive stress exceeding the steel's elastic limit, the spring property maintained after deformation during use in such a case increases with higher spring property of the steel before aging. In other words, the stainless steel should preferably already have excellent spring property before aging and impartation of excellent spring property for the first time by aging is not advisable. Given the present state of the art, therefore, an attempt to boost the performance of stainless steels of this type for use in metal gaskets is unlikely to be successful.

The type (B) precipitation-hardened stainless steels must contain age-hardening elements such as Cu, Al, Ti and Mo. The generally high price of these elements raises the starting material cost. In addition, the need for an aging furnace makes the initial outlay for equipment enormous. Production cost is also high owing to the numerous production processes required.

The type (C) quench-hardened stainless steels are generally lower in strength than the type (A) and (B) stainless steels. An attempt to enhance strength by skin-pass rolling or inclusion of large amounts of C or N is apt to degrade toughness. Achieving a high level of strength as well as good toughness in the type (C) steels is therefore no easy matter. As far as the inventors are aware, no type (C) stainless steel that succeeds on both counts has been made available.

The inventors conducted an extensive study in search of a method enabling low-cost production of a stainless steel excellent in spring property and exhibiting both high strength and toughness. As a result, it was concluded that the type (C) quench-hardened stainless steels still had room for development. A first object of the present invention is therefore to provide a type (C) quench-hardened stainless steel that possesses high strength comparable to SUS301, a typical type (A) work-hardened stainless steel, and further exhibits excellent toughness and spring property capable of meeting the increasingly severe requirements for use in metal gaskets.

The properties required of a stainless steel for use in metal gaskets are particularly demanding. The steel is required to have excellent fatigue property so it can stand up under the high temperature, high pressure, harsh vibration, and repeated temperature and pressure changes peculiar to engines. It must also have excellent shape-retaining property (shape freezing property) so that after being precision-machined to a shape for optimum sealing performance it can retain this shape without change even under the aforesaid severe use environment. While excellent resistance to permanent set can be considered essential for a stainless steel to achieve excellent in fatigue property and shape freezing property, no type (C) stainless steel excellent in resistance to permanent set has yet been developed, wherein the permanent set means a permanent shape change which has been occurred in the usage of the material as a spring or gasket under compressive load, and can be evaluated for instance by specified fatigue test as described in Example 4 hereinafter. A second object of the present invention is therefore to provide a stainless steel sheet having the foregoing properties desirable for use in metal gaskets.

The inventors further discovered that production of a stainless steel sheet enhanced in strength from the foregoing perspective encountered previously unexperienced problems that needed to be solved. Specifically, trouble was encountered during cold rolling. When the rolling loads required during cold rolling were compared between such improved stainless steel sheet in accordance with the present invention and a conventional quench-hardened stainless steel sheet, the rolling load required by the improved stainless steel sheet was markedly greater in proportion to its higher strength. In addition, the improved steel sheet tended to experience edge cracking. Edge cracking must be avoided by all means because it not only degrades product quality but also poses a safety issue during steel sheet production. When edge cracking having an effect on later processing steps arises, the only alternative is to cut away the edge portions of the steel sheet by the width of the cracked region using a trimmer or the like. This trimming adds another step to the production process and lowers production yield. It therefore leads to a large increase in production cost. A third object of the invention is therefore to provide a method of markedly inhibiting cold-rolled steel sheet edge cracking in the production of a stainless steel sheet having high strength comparable to SUS301 and also excellent in toughness and spring property.

SUMMARY OF THE INVENTION

Regarding the matensitic stainless steels classified under the aforesaid type (C) quench-hardened stainless steels, the inventors learned through the research that by regulating C, N and Ni content and further controlling amount of δ ferrite and amount of residual austenite there can be obtained a high-strength steel that is superior to a conventional quench-hardened stainless steel in strength, toughness and spring property, superior to a work-hardened stainless steel in productivity and uniformity of product properties, and cheaper than a precipitation-hardened stainless steel.

Through further studies regarding optimization for metal gasket applications in particular, it is found that imparting a metallic structure composed of not less than 85 vol % martensite phase in the quenched state, in addition to regulating C, N and Ni content, is very effective for improving the fatigue property of a type (C) steel. As a result of repeated experimentation, it is discovered that it is highly effective for improvement of resistance to permanent set during metal gasket use for the steel to exhibit a high spring bending elastic limit after being imparted with a certain amount of strain. Specifically, it was found that a metal gasket steel capable of satisfying today's demanding requirements could be obtained when a test specimen imparted with 0.1% tensile strain was made to have a spring bending elastic limit $Kb_{0.1}$ measured in conformity with JIS (Japanese Industrial Standard) H 3130 of not less than 700 $N/mm^2$. The inventors additionally ascertained that occurrence of microcracks during bead formation can be effectively suppressed by regulating composition and production conditions to regulate uniform elongation or tensile strength to an appropriate level.

Another clear finding is that in order to markedly suppress edge cracking during cold rolling of such a steel it is highly important to 1) reduce the degree of surface roughening at the steel sheet edge portions to the absolute minimum during hot rolling, 2) hold down steel sheet hardness before cold rolling, and 3) suppress grain boundary precipitation of carbides and nitrides during intermediate annealing conducted before cold rolling. For achieving point 1), it was found to be effective to incorporate an appropriate amount of B as an alloying component and to regulate the composition so as to keep the amount of δ ferrite below a certain level. For achieving points 2) and 3), it was found to be effective to strictly control the conditions of the intermediate annealing conducted before cold rolling.

The present invention was accomplished based on the foregoing new knowledge.

Specifically, in a first aspect, the invention provides a high-strength, high-toughness martensitic stainless steel sheet having a chemical composition comprising, in mass percent, more than 0.03 to 0.15% of C, 0.2–2.0% of Si, not more than 1.0% of Mn, not more than 0.06% of P, not more than 0.006% of S, 2.0–5.0% of Ni, 14.0–17.0% of Cr, more than 0.03 to 0.10% of N, 0.0010–0.0070% of B, and the balance of Fe and unavoidable impurities and having an A value defined by Equation (1) of not less than minus(−)1.8:

$$\text{A value}=30(C+N)-1.5Si+0.5Mn+Ni-1.3Cr+11.8 \quad (1),$$

provided that each element symbol on the right side of Equation (1) is replaced by a value representing the content of the element in mass percent.

"Steel sheet" as termed with respect to the present invention is defined to include "steel strip."

In a second aspect of the invention, the steel sheet according to the first aspect is a high-strength, high-toughness martensitic stainless steel sheet whose edges at opposite lateral extremities of the steel sheet are edges formed by cold rolling that have no edge cracks of a length greater than 1 mm.

In a third aspect, the invention provides a high-strength, high-toughness martensitic stainless steel sheet for metal gaskets comprising, in mass percent, more than 0.03 to 0.15% of C, 0.2–2.0% of Si, not more than 1.0% of Mn, not more than 0.06% of P, not more than 0.006% of S, 2.0–5.0% of Ni, 14.0–17.0% of Cr, more than 0.03 to 0.10% of N, 0.0010–0.0070% of B, and the balance of Fe and unavoidable impurities and including not less than 85 vol % martensite phase, a test specimen of which imparted with a nominal tensile strain of 0.1% exhibits a spring bending elastic limit $Kb_{0.1}$ measured in conformity with JIS H 3130 of not less than 700 $N/mm^2$.

$Kb_{0.1}$ is the spring bending elastic limit when permanent deflection is 0.1 mm in the moment-type test according to JIS H 3130.

In a fourth aspect of the invention, the steel sheet according to the third aspect further comprises one or both of Mo and Cu at a total of not less than 2.0 mass percent.

In a fifth aspect of the invention, the steel sheet according the third or fourth aspect has a chemical composition wherein A value defined by Equation (1) above is not less than −1.8.

In a sixth aspect of the invention, the steel sheet according to any of the third to fifth aspects has a uniform elongation of not less than 0.3%.

In a seventh aspect of the invention, the steel sheet according to any of the third to sixth aspects has a tensile strength of 1,400–1,700 $N/mm^2$.

In an eighth aspect, the invention provides a method of inhibiting cold-rolled steel sheet edge cracking of a high-strength, high-toughness martensitic stainless steel sheet, which method is applied with respect to a hot-rolled steel sheet of matensitic stainless steel having a chemical composition comprising, in mass percent, more than 0.03 to 0.15% of C, 0.2–2.0% of Si, not more than 1.0% of Mn, not more than 0.06% of P, not more than 0.006% of S, 2.0–5.0% of Ni, 14.0–17.0% of Cr, more than 0.03 to 0.10% of N, 0.0010–0.0070% of B, and the balance of Fe and unavoidable impurities and having an A value defined by Equation (1) below of not less than −1.8:

$$\text{A value}=30(C+N)-1.5Si+0.5Mn+Ni-1.3Cr+11.8 \quad (1),$$

and comprises a step of subjecting the sheet to a single cycle or multiple repeated cycles of a process (intermediate annealing and cold rolling process) consisting of intermediate-annealing the sheet at a soaking temperature of 600–800° C. for a soaking period of not more than 10 hr to adjust steel hardness to Vickers hardness (Hv) of not greater than 380, followed by cold rolling.

Conceptually, "soaking temperature" means the constant temperature maintained by the steel sheet once its temperature has become uniform in the thickness direction in the course of temperature rise during heating. Actually, however, accurate determination of this temperature is difficult. As the steel sheet temperature approaches the furnace temperature, moreover, the rate of temperature increase slows to such an extent as to reach a metallurgical state that is substantially no different from that of the temperature being uniform in the direction of sheet thickness. In this invention, therefore, the soaking temperature is defined as: average of temperature $T_1$ (° C.) and temperature $T_2$ (° C.), i.e., temperature $(T_1+T_2)/2$, where $T_1$ (° C.) is the steel sheet surface temperature when, in the course of temperature increase during steel sheet heating, the rate of temperature increase at the steel sheet surface becomes not greater than 2° C./sec and $T_2$ (° C.) is the ultimate steel sheet surface temperature reached thereafter prior to the start of cooling. The steel sheet surface temperature can be measured by, for instance, a thermocouple spot welded on the steel sheet surface.

Conceptually, "soaking period" means the time period during which the steel sheet maintains a constant temperature once its temperature has become uniform in the thickness direction in the course of temperature rise during heating. In this invention, however, the soaking period is defined as: period between the time point at which, in the course of temperature increase during steel sheet heating, the rate of temperature increase at the steel sheet surface becomes not greater than 2° C./sec and the time point at the start of cooling. "Soaking period of not more than 10 hr" is defined to include the case in which cooling starts as soon as the rate of temperature increase at the steel sheet surface becomes not greater than 2° C./sec (zero-second soaking).

A ninth aspect of the invention provides a method according to the eighth aspect, wherein, in addition to adjusting steel hardness after intermediate annealing to Vickers hardness (Hv) of not greater than 380, the soaking temperature is a temperature in a range of x (° C.) satisfying Z value≦380 in Equation (2):

$$\text{Z value}=61C-6Si-7Mn-1.3Ni-4Cr-36N-7.927\times10^{-6}x^3+1.854\times10^{-2}x^2-13.74x+3663 \quad (2),$$

provided that each element symbol on the right side of Equation (2) is replaced by a value representing the content of the element in mass percent and x is soaking temperature (unit: ° C.).

A tenth aspect of the invention provides a method according to the eighth or ninth aspect, wherein the intermediate annealing soaking period in each cycle of the intermediate annealing and cold rolling process is not greater than 300 sec.

An eleventh aspect of the invention provides a method according to any of the eighth to tenth aspects, wherein the cold rolling reduction ratio in each cycle of the intermediate annealing and cold rolling process is not greater than 85%. When multiple repeated cycles of the intermediate annealing and cold rolling process are conducted, the cold rolling reduction ratio is made not greater than 85% in every cycle. However, the cold rolling reduction ratio need not be the same in every cycle.

A twelfth aspect of the invention provides a method of producing a high-strength, high-toughness martensitic stainless steel sheet while inhibiting cold-rolled steel sheet edge cracking, which method comprises subjecting a cold-rolled sheet produced according to and having undergone the intermediate annealing and cold rolling process of the method of any of the eighth to eleventh aspects to finish annealing at a soaking temperature of 950–1,050° C. for a soaking period of not greater than 300 sec, without first subjecting it to trimming of edges at opposite lateral extremities.

The finish annealing here is annealing imparted at the end of the process for producing a steel sheet exhibiting high strength, high toughness and excellent spring property. The soaking temperature and soaking period are defined in the same manner as in the earlier intermediate annealing. The finish annealing also includes the case of zero-second-soaking.

A thirteenth aspect of the invention provides a method according to the twelfth aspect, wherein skin-pass rolling is effected at a reduction ratio of 1–10% after the finish annealing.

DESCRIPTION OF THE PREFERRED EMBODIMENTS

Figures 1, 1A:
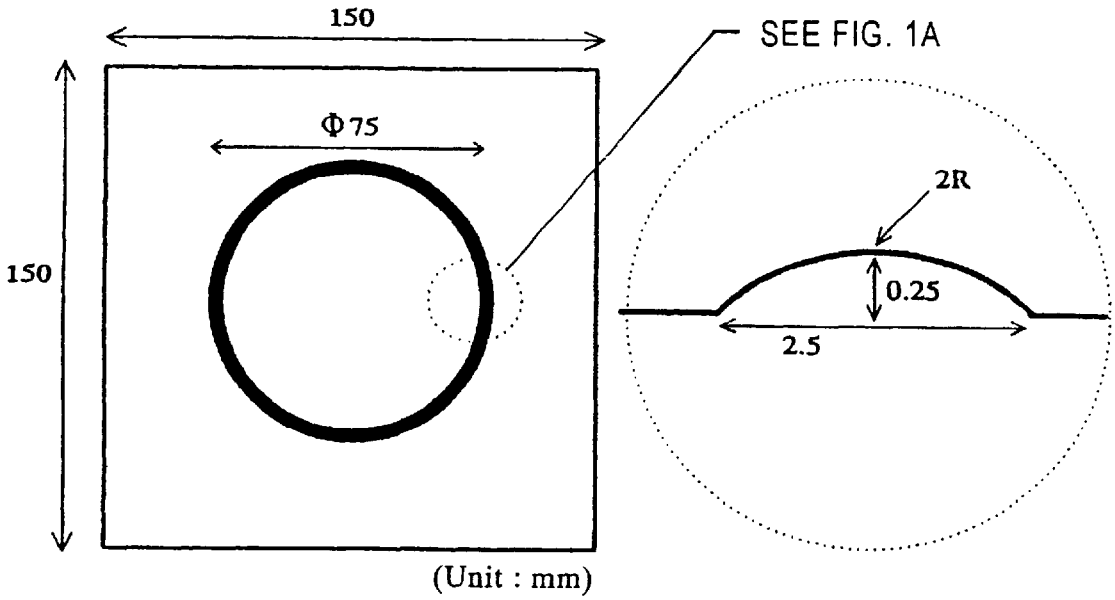
FIG. 1 shows a plan view of the shape of a test piece having a head portion and FIG. 1A shows a partial enlarged sectional view of the head portion of FIG. 1.

Both from the aspect of achieving high strength and high toughness in a martensitic stainless steel sheet and in the aspect of inhibiting cold-rolled sheet edge cracking during production of the high-strength steel sheet, the present invention requires strict definition of the steel chemical composition. The reasons for limiting the chemical constituents of the steel will now be explained.

C (carbon) is an important element for enhancing steel strength by solid-solution strengthening and for suppressing occurrence of δ ferrite phase at high temperature. A C content exceeding 0.03 mass percent is required to obtain effective solid-solution strengthening capability. At a high content exceeding 0.15 mass percent, however, the amount of carbides (or carbides accompanying nitrides) precipitated at the grain boundaries during intermediate annealing becomes so large as to promote ready edge cracking during the ensuing cold rolling. Another disadvantage of such a high C content is that a large amount of austenite remains after finish annealing, making it difficult to achieve high strength and also degrading toughness and spring property. C content is therefore defined as more than 0.03 to 0.15 mass percent.

Si (silicon) has powerful solid-solution strengthening capability and strengthens the steel matrix. This effect appears at an Si content of 0.2 mass percent or greater. When the Si is present at greater than 2.0 mass percent, however, its solid-solution strengthening action saturates and degradation of toughness and spring property becomes pronounced because δ ferrite phase generation is promoted. The Si content is therefore defined as 0.2–2.0 mass percent.

Mn (manganese) suppresses generation of δ phase in the high-temperature region. When the Mn content is great, however, the amount of residual austenite after finish annealing becomes so large as to degrade strength and spring property. Mn content is therefore defined as not greater than 1.0 mass percent. The preferable Mn content range is 0.2–0.6 mass percent.

P (phosphorus) degrades toughness and corrosion resistance, so that the lower its content the better. A P content of up to 0.06 mass percent is tolerable in the present invention.

S (sulfur) is present in the steel in the form of MnS and as other nonmetallic inclusions that have an adverse effect on toughness when present in a large amount. S also segregates at the grain boundaries during hot rolling to become a cause of hot rolling cracking and surface roughening. The problem of hot rolling cracking can be substantially overcome by keeping the S content to not greater than around 0.01 mass percent. It was found, however, that inhibition of edge cracking during cold rolling is difficult to achieve at an S content of greater than 0.006 mass percent because surface roughening during hot rolling cannot be sufficiently prevented. The invention therefore limits S content to not more than 0.006 mass percent.

Ni (nickel) replaces part of C and N, which, like Ni, are also austenite-forming elements, and by this action effectively prevents toughness degradation owing to addition of large amounts of C and N. Ni also suppresses generation of δ ferrite phase. In the alloy system of this invention, an Ni content of at least 2.0 mass percent is needed to reduce the amount of δ ferrite phase after casting to an extent sufficient for preventing surface roughness during hot rolling and maintaining toughness. At a high Ni content exceeding 5.0 mass percent, however, the amount of residual austenite increases to an excessive level that causes strength degradation. Although in such a case the amount of residual austenite can be reduced by lowering the C and N content, it then becomes impossible achieve high strength because solid-solution strengthening by C and N cannot be adequately manifested. Addition of Ni is therefore important in this invention. The content thereof is defined as 2.0–5.0 mass percent.

Cr (chromium) is required to be present in the steel of this invention at a content of not less than 14.0 mass percent in order to achieve excellent corrosion resistance. When the Cr content exceeds 16.5 mass percent, however, the amount of δ ferrite in the as-cast state and the final product becomes large. The presence of some amount of δ ferrite phase does not adversely affect the quality of the steel sheet edge portions after hot rolling and the spring property of the product to a great degree. When the Cr content exceeds 17.0 mass percent, however, the accompanying rise in δ ferrite phase increases the degree of surface roughening at the steel sheet edge portions to the point that inhibition of edge cracking during cold rolling is difficult even when the intermediate annealing conditions explained later are adopted. An attempt to overcome this problem by adjusting the steel composition so as to suppress generation of δ ferrite phase would require addition of a large amount of an austenite-forming element. As this would result in a large amount of residual austenite phase after finish annealing, however, it would degrade strength and spring property. Cr content is therefore limited to the range of 14.0–17.0 mass percent.

N (nitrogen), like C, suppresses occurrence of δ ferrite phase and enhances steel strength by solid-solution strengthening. Moreover, part of C can be replaced by N to make inclusion of a large amount of C unnecessary and thus avoid corrosion resistance degradation owing to precipitation of Cr carbide in the vicinity of the grain boundaries during cooling after intermediate or finish annealing. An N content of at least 0.03 mass percent is required to obtain these effects. At a high N content in excess of 0.10 mass percent, however, the degree of work hardening during cold rolling after intermediate annealing becomes great to increase the rolling load and make edge cracking likely. In addition, since the amount of residual austenite after finish annealing becomes large, good strength and spring property cannot be obtained. N content is therefore defined as more than 0.03 to 0.10 mass percent.

B (boron) is a very important element in this invention for suppressing edge cracking during cold rolling. B is generally added to a stainless steel for the purpose of improving hot workability. However, in a matensitic stainless steel, the subject of this invention, inclusion of B for the purpose of improving hot workability is unnecessary because hot cracking can be sufficiently prevented by reducing S content to not greater than 0.01 mass percent. On the other hand, extensive research conducted by the inventors revealed that B manifests a marked action of preventing surface roughening during hot rolling in the type of steel to which this invention relates. In addition, B also effectively suppresses segregation of S at the grain boundaries during intermediate annealing. This invention utilizes these effects of B for significantly curbing the occurrence of edge cracking during cold rolling. A study conducted by the inventors showed that a B content of not less than 0.0010 mass percent is required to achieve marked suppression of cold-rolled sheet edge cracking in the present invention. At a B content in excess of 0.0070 mass percent, however, the edge cracking suppressing action reaches saturation and degradation of final product toughness owing to B-system precipitates at the grain boundaries becomes notable. B content is therefore set at 0.0010–0.0070 mass percent.

Mo (molybdenum) and Cu (copper) are effective elements for imparting excellent corrosion resistance to gasket steel. These elements are relatively expensive, however, and when present in a large amount exceeding a total of 2.0 mass percent make little further contribution to corrosion resistance but rather degrade the resistance to permanent set and fatigue property by promoting generation of residual austenite and δ ferrite. When Mo and Cu are incorporated, therefore, the total amount thereof is preferably not greater than 2.0 mass percent.

The constituent elements of the invention steel should not only fall within the foregoing content ranges but should also preferably be adjusted so that A value defined by Equation (1) above is not less than −1.8. While A value is an index that agrees well with the amount of δ ferrite after finish annealing, it also corresponds closely to the amount of δ ferrite in the as-cast state. When A value of a steel whose constituent elements fall within the foregoing content ranges is −1.8 or greater, the amount of δ ferrite in the as-cast state is not greater than around 10 vol %. In this case, the degree of surface roughening after hot rolling is markedly mitigated and edge cracking during cold rolling can be prevented by conducting the intermediate annealing explained later. When the chemical composition is such that A value falls below −1.8, the tendency of the steel to experience edge cracking intensifies and edge cracks of a length greater than 1 mm occur locally or throughout. When a steel of the type envisioned by this invention incurs edge cracks longer than 1 mm, productivity in the ensuing processing and product quality are seriously affected. The cracked edge portions of the steel sheet therefore must be trimmed by a width equal to or greater than the maximum edge crack length. This markedly lowers yield and raises production cost. In this invention, therefore, the chemical composition of the steel is preferably defined so that A value defined by Equation (1) is not less than −1.8.

The metallic structure and mechanical properties of a steel sheet particularly suitable for use in metal gaskets will now be explained.

A steel sheet for this purpose preferably has a metallic structure composed of not less than 85 vol % of martensite phase. When martensite is below 85 vol %, high hardness is difficult to achieve consistently, making it impossible to realize the excellent resistance to permanent set property and fatigue property required in present-day applications. A structure composed of not less than 85% martensite can be obtained by adjusting the constituent elements of the steel to fall within the aforesaid ranges and controlling the finish annealing, skin-pass rolling and other production conditions. Phase(s) other than martensite phase can be either residual austenite phase or ferrite phase. Ferrite remaining as δ ferrite phase distributed in the rolling direction is undesirable, however, because it prevents achievement of the spring bending elastic limit of not less than 700 N/mm$^2$ discussed later and also tends to degrade toughness. δ ferrite phase distributed in strata is therefore preferably not greater than 3.0 vol %.

As a mechanical property, the spring bending elastic limit $Kb_{0.1}$ under an imparted tensile strain of at least 0.1% is required to be not less than about 700 N/mm$^2$. A steel that exhibits a high spring bending elastic limit before bead formation may, after release of compressive residual stress by impartation of tensile stress by a press during bead formation, exhibit a lower spring bending elastic limit than before bead formation. When $Kb_{0.1}$ after bead formation is lower than 700 N/mm$^2$, the resistance to permanent set property obtainable is no better than that of conventional steels such as SUS301 and SUS304. The resistance to permanent set property is therefore liable to be insufficient under some use environments. It was found that when the strain imparted by bead formation is evaluated as tensile strain, the spring bending elastic limit under application of tensile strain of 0.1% or greater is in good agreement with that after bead formation. Even though a steel exhibits $Kb_{0.1}$ of 700 N/mm$^2$ or greater after heat treatment or skin-pass rolling, it is not suitable for metal gasket applications with severe property requirements if its $Kb_{0.1}$ drops below 700 N/mm$^2$ when thereafter imparted with tensile strain.

The inventors therefore collected test specimens from steel sheet materials intended for bead formation and used them to study various methods in search of one universally applicable for evaluating the suitability of a steel sheet for use in metal gaskets. As a result, it was found that when a test specimen of a steel sheet imparted with a nominal tensile strain of 0.1% exhibits a spring bending elastic limit $Kb_{0.1}$ measured in conformity with JIS H 3130 of not less than 700 N/mm$^2$, the steel sheet can be judged to have good characteristics. The spring bending elastic limit $Kb_{0.1}$ defined by the present invention is based on this knowledge.

In order to avoid thickness nonuniformity and generation of edge microcracks during bead formation and thus prevent associated degradation of the resistance to permanent set property and fatigue property, it is preferable not only to define the value of $Kb_{0.1}$ but also to stipulate the steel composition and the production conditions to obtain uniform elongation of not less than 0.3%. Uniform elongation of not less than 0.3% can be substantially achieved in a steel of a composition falling within the range defined by this invention by holding tensile strength to not greater than 1,700 N/mm$^2$. However, tensile strength must not be lower than 1,400 N/mm$^2$. The stipulation "tensile strength of 1,400–1,700 N/mm$^2$" can therefore be adopted in place of the stipulation "uniform elongation of not less than 0.3%." Preferably, both "uniform elongation of not less than 0.3%" and "tensile strength of 1,400–1,700 N/mm$^2$" should be satisfied.

The intermediate annealing will now be explained. The intermediate annealing in this invention is highly important from the aspect of suppressing edge cracking. The inventors' research demonstrated that edge cracking during cold rolling is markedly suppressed when the steel sheet before cold rolling has Vickers hardness of not greater than 380 (Hv 380) and has undergone thorough suppression of carbide-nitride precipitation. Annealing at a soaking temperature of 600–800° C. for a soaking period of up to a maximum of 10 hr was found necessary for realizing a soft steel sheet with very low precipitate content such as this.

Working strain introduced into the steel sheet during hot rolling or cold rolling must be effectively removed to soften the steel sheet sufficiently. This requires a soaking temperature of not lower than 600° C. Although increasing the steel sheet temperature enhances the strain removing effect, it leads to generation of reverse-transformed austenite. A quenching phenomenon then arises during cooling to increase the hardness of the intermediate-annealed steel sheet. When the soaking temperature exceeds 800° C., a softness of Hv 380 or lower is difficult to achieve even by adjusting the steel composition. Use of an intermediate annealing soaking temperature in the range of 600–800° C. is therefore critical.

The experience of the inventors during a series of intermediate annealing tests was that consistent achievement of a softness of Hv 380 or lower with good reproducibility is not always easy. Upon looking into the reason for this, it was found first that intermediate annealing involves a pair of contrary phenomena, "softening by strain removal" and "hardening by quenching," and second that susceptibility to the quenching phenomenon differs depending on the chemical composition of the steel. The inventors therefore carried out intensive research for determining intermediate annealing conditions based on chemical composition for consistently achieving softness of not greater than Hv 380. This led to the discovery of the index Z value defined by Equation (2) set out earlier.

Specifically, the inventors conceived intermediate annealing conditions wherein the soaking temperature falls in the range of x (° C.) satisfying Z value≦380 in Equation (2). A steel sheet of Hv 380 or lower can be consistently obtained under these conditions.

It is important to set an intermediate annealing soaking period of within 10 hr. When the soaking period exceeds 10 hr, occurrence of heavy grain-boundary carbide-nitride precipitation frustrates the attempt to suppress edge cracking during cold rolling even when the steel sheet is a soft one of Hv 380 or below. No particular lower limit need be set for the soaking period. Annealing with zero-second soaking suffices. In the interest of ensuring stable product quality and the like in an actual industrial operation, however, when continuous annealing is conducted the intermediate annealing soaking period should preferably be set at 0–300 sec, more preferably 0–60 sec. In the case of batch annealing, a soaking period in the range of 0–10 hr is workable but one in the range of 0–3 hr is preferable.

In this invention, edge cracking of a steel sheet during cold rolling is suppressed by subjecting the steel sheet to the foregoing intermediate annealing before the cold rolling. The cold rolling reduction ratio is preferably kept to not greater than 85%. When desired, a greater reduction of sheet thickness can be realized by repeating the intermediate annealing and cold rolling process under the foregoing conditions multiple times.

After completion of the intermediate annealing and cold rolling process as described above, the steel sheet can, thanks to marked suppression of edge cracking during cold rolling, be directly subjected to finish annealing without trimming of the edges at opposite lateral extremities. In the finish annealing, the steel sheet is heated to and held in the austenite single-phase region to obtain a quenched martensite structure after cooling. Since an important aspect of this invention is to ensure high toughness after finish annealing, the grain diameter of the former austenite in the martensite structure must be refined. The refinement can be achieved by controlling the soaking temperature in the finish annealing to 1,050° C. At a low soaking temperature below 950° C., however, persistence or precipitation of carbides-nitrides and the like lower strength and toughness. The finish annealing soaking temperature is therefore preferably selected in the range of 950–1,050° C. The finish annealing soaking period is preferably set at not longer than 300 sec (including 0 sec).

After finish annealing, skin-pass rolling is preferably conducted for imparting a still higher level of strength and spring property. In the research, the inventors observed a strength and spring property improving effect even at a slight skin-pass rolling reduction of, for example, 0.5%. A skin-pass rolling reduction of not less than 1% is preferable, however, because property stability is poor at an excessively low reduction and also because excellent spring property suitable for a wide range of spring applications can be obtained when the skin-pass rolling reduction is 1% or greater. When the skin-pass rolling reduction exceeds 10%, problems arise in connection with toughness and, in addition, operation and production efficiency decline owing to higher rolling load caused by increased strength. Skin-pass rolling is therefore preferably conducted at a reduction of 1–10%.

WORKING EXAMPLES

EXAMPLE 1

Hot-rolled sheets of 4.0-mm thickness were produced by hot rolling 100-Kg steel ingots obtained by casting molten steels of the chemical compositions shown in Table 1. In Table 1, A1–A8 are invention steels whose chemical compositions fall within the range specified by the invention, B1–B9 are comparative steels, and C1 is the conventional steel SUS301. The A value of each steel is also shown in the table.

TABLE 1

| Steel | Alloy components and content (mass percent) | | | | | | | | | Value |
|---|---|---|---|---|---|---|---|---|---|---|
| No. | C | Si | Mn | P | S | Ni | Cr | N | B | A |
| A1 | 0.079 | 0.48 | 0.19 | 0.028 | 0.0026 | 4.02 | 15.67 | 0.068 | 0.0039 | −0.77 |
| A2 | 0.084 | 0.64 | 0.73 | 0.030 | 0.0034 | 3.51 | 16.04 | 0.081 | 0.0030 | −1.09 |
| A3 | 0.058 | 0.79 | 0.45 | 0.018 | 0.0028 | 3.58 | 14.92 | 0.056 | 0.0043 | −1.56 |
| A4 | 0.143 | 0.22 | 0.69 | 0.042 | 0.0010 | 2.96 | 16.80 | 0.035 | 0.0035 | −1.73 |
| A5 | 0.097 | 1.95 | 0.48 | 0.019 | 0.0043 | 4.92 | 14.07 | 0.064 | 0.0018 | 0.57 |
| A6 | 0.060 | 1.24 | 0.93 | 0.055 | 0.0032 | 3.44 | 14.75 | 0.074 | 0.0067 | −1.31 |
| A7 | 0.082 | 0.42 | 0.23 | 0.030 | 0.0057 | 3.89 | 15.78 | 0.070 | 0.0013 | −0.78 |
| A8 | 0.033 | 1.70 | 0.37 | 0.031 | 0.0013 | 4.35 | 14.65 | 0.096 | 0.0052 | −1.39 |
| B1 | 0.064 | 0.43 | 0.23 | 0.031 | 0.0023 | 3.97 | 15.86 | 0.054 | 0.0042 | −1.84 |
| B2 | 0.080 | 0.51 | 0.28 | 0.040 | 0.0032 | 4.03 | 16.67 | 0.071 | 0.0029 | −1.94 |
| B3 | 0.076 | 0.50 | 0.14 | 0.029 | 0.0027 | 3.99 | 15.58 | 0.069 | 0.0007 | −0.79 |
| B4 | 0.158 | 0.38 | 0.34 | 0.018 | 0.0038 | 3.67 | 16.28 | 0.018 | 0.0022 | −0.81 |
| B5 | 0.101 | 0.39 | 0.25 | 0.022 | 0.0066 | 4.04 | 16.50 | 0.063 | 0.0036 | −1.15 |
| B6 | 0.092 | 0.53 | 0.18 | 0.034 | 0.0025 | 4.08 | 15.83 | 0.062 | 0.0077 | −0.78 |
| B7 | 0.083 | 0.27 | 0.75 | 0.042 | 0.0037 | 3.07 | 14.74 | 0.108 | 0.0050 | 1.41 |
| B8 | 0.081 | 0.54 | 0.17 | 0.028 | 0.0029 | 5.12 | 15.17 | 0.075 | 0.0041 | 1.15 |
| B9 | 0.079 | 0.18 | 0.20 | 0.037 | 0.0040 | 4.09 | 17.09 | 0.086 | 0.0028 | −1.55 |
| C1 | 0.118 | 0.51 | 1.08 | 0.026 | 0.0012 | 7.46 | 17.16 | 0.025 | — | — |

Remark:
A1–A8: Invention steels
B1–B9: Comparative steels
C1: Prior-art steel (SUS301)

The A1–A4, A7, B1–B3 and B5 hot-rolled sheets were confirmed to be free of edge cracks, intermediate-annealed at a soaking temperature of 740° C. for a soaking period of 60 sec, and cold-rolled at a reduction ratio 60%. After each cold-rolling pass the sheets were inspected for edge cracks and rated as follows:

| Rating | Edge cracking |
|---|---|
| x | Cracks measuring 1.0 mm or more in length observed at steel sheet edges at reduction of less than 30% |
| Δ | Cracks measuring 1.0 mm or more in length observed at steel sheet edges at reduction of 30–60% |
| ○ | No cracks measuring 1.0 mm or more in length observed up to reduction of 60% |

The results are shown in Table 2 along with the A value, amount of δ ferrite in the as-cast state and the measured hardness after intermediate annealing of the respective steels. The amount of δ ferrite in the as-cast state was determined by observing the metallic structure at the surface of the ingot with an optical microscope.

TABLE 2

| Steel No. | A value | Amount of δ ferrite in the as-cast state (Vol %) | Measured hardness after intermediate annealing (Hv) | Edge cracking |
|---|---|---|---|---|
| A1 | −0.77 | 2.7 | 367 | ○ |
| A2 | −1.19 | 4.3 | 359 | ○ |
| A3 | −1.56 | 7.4 | 362 | ○ |
| A4 | −1.73 | 9.2 | 363 | ○ |
| A7 | −0.78 | 2.4 | 364 | ○ |
| B1 | −1.84 | 10.9 | 363 | Δ |
| B2 | −1.94 | 13.0 | 360 | x |
| B3 | −0.79 | 2.5 | 364 | Δ |
| B5 | −1.15 | 3.8 | 363 | Δ |

Remark:
A1–A4, A7: Invention steels
B1–B3, B5: Comparative steels

As shown in Table 2, the invention examples using steels having chemical compositions within the range specified by the present invention experienced absolutely no edge cracking up to a cold rolling reduction ratio of 60%. In contrast, B1 and B2, whose A value was below −1.8 and amount of δ ferrite in the as-cast state exceeded 10 vol %, B3, whose B content was lower than that specified by the invention, and B5, whose S content exceed the upper limit defined by the invention, all experienced edge cracks of 1.0 mm or greater during cold rolling, despite the fact that their hardnesses after intermediate annealing were comparable to those of the invention examples. From these results it was verified that in order to suppress edge cracking during cold rolling: B addition is essential, amount of δ ferrite in the as-cast state should be made not greater than 10 vol % by adopting a chemical composition that makes A value not less than −1.8, and S content should be reduced to within the range specified by the invention.

EXAMPLE 2

The A1 and A4 hot-rolled steel sheets shown in Table 1 were intermediate-annealed under various heat-treatment conditions, cold-rolled at a reduction ratio of 60%, and examined for effect of intermediate annealing conditions on edge cracking during cold rolling. The intermediate annealing soaking temperature, intermediate annealing soaking period, measured hardness after intermediate annealing, Z value, and state of edge cracking of each steel sheet are shown in Table 3. Edge cracking was evaluated against the same criteria as in Example 1.

TABLE 3

| | Test No. | Steel No. | Intermediate annealing conditions: Soaking temperature (° C.) | Intermediate annealing conditions: Soaking period | Measured hardness after intermediate annealing (Hv) | Value Z | Edge cracking |
|---|---|---|---|---|---|---|---|
| Inv | R1 | A1 | 650 | 60 sec | 308 | 318 | ○ |
| | R2 | | 700 | | 335 | 341 | ○ |
| | R3 | | 720 | | 350 | 353 | ○ |
| | R4 | | 740 | | 366 | 366 | ○ |
| | R5 | | 760 | | 379 | 380 | ○ |
| Comp | R6 | | 770 | | 389 | 387 | Δ |
| | R7 | | 780 | | 393 | 394 | Δ |
| | R8 | | 800 | | 406 | 408 | x |
| | R9 | | 820 | | 419 | 422 | x |
| Inv | R10 | | 740 | 120 sec | 368 | 366 | ○ |
| | R11 | | 740 | 300 sec | 370 | 366 | ○ |
| Inv | R14 | A4 | 650 | 60 sec | 306 | 310 | ○ |
| | R15 | | 700 | | 328 | 332 | ○ |
| | R16 | | 720 | | 344 | 344 | ○ |
| | R17 | | 740 | | 359 | 357 | ○ |
| | R18 | A4 | 760 | | 372 | 371 | ○ |
| | R19 | | 770 | | 377 | 378 | ○ |
| Comp | R20 | | 780 | | 386 | 385 | Δ |
| | R21 | | 800 | | 400 | 399 | Δ |
| | R22 | | 820 | | 410 | 413 | x |
| Inv | R31 | A1 | 740 | 6 hr | 368 | 366 | ○ |
| | R32 | | 740 | 8 hr | 369 | 366 | ○ |
| | R33 | | 740 | 10 hr | 370 | 366 | ○ |
| Comp | R34 | | 740 | 14 hr | 377 | 366 | Δ |
| | R35 | | 740 | 24 hr | 384 | 366 | Δ |
| Inv | R36 | A4 | 720 | 6 hr | 345 | 344 | ○ |
| | R37 | | 770 | | 378 | 378 | ○ |

Remark:
Inv: Invention example
Comp: Comparative example

As shown in Table 3, among the steel sheets whose intermediate annealing soaking period was no longer than 10 hr, those whose measured hardness after intermediate annealing was not greater than Hv 380 experienced absolutely no edge cracking by 60% cold rolling. In contrast, those whose measured hardness was greater than Hv 380 (R6–R9, R20–R22) incurred cold edge cracking. The steel sheets whose hardness exceeded Hv 380 are thought to have hardened owing quenching that occurred because of reverse-transformed austenite phase generation during intermediate annealing. The steels whose soaking period was longer than 10 hr (R34, R35) experienced edge cracking. This is thought to be due to heavy precipitation of carbides-nitrides at the grain boundaries caused by the prolonged intermediate annealing. From these results, it was verified that keeping the intermediate annealing soaking period to within 10 hr and maintaining hardness after intermediate annealing at Hv 380 or less is effective for preventing edge cracking during cold rolling.

It can also be seen that measured hardness after intermediate annealing and Z value were in good agreement when the soaking period was no longer than 10 hr. Specifically, it was verified that excellent, edge-crack-free cold-rolled sheets can be stably produced by conducting intermediate annealing under conditions that keep Z value at or below 380.

Although R6 (steel A1) and R19 (steel A4) were intermediate-annealed under the same conditions, R6 experienced edge cracking while R19 did not. This dissimilarity occurred because the two steel sheets differed in hardness after intermediate annealing owing to their different chemical compositions. Thus it can be seen that the soaking temperature range within which hardness of not greater than Hv 380 after intermediate annealing can be obtained varies with chemical composition. Chemical composition must therefore be carefully considered in setting the intermediate annealing conditions. From this viewpoint, Z value defined by Equation (2) is, as an index indicative of the dependency of soaking temperature on chemical composition, useful for determining the intermediate annealing conditions.

EXAMPLE 3

Cold-rolled sheets were produced from the A1–A8, B4, and B6–B9 hot-rolled sheets shown in Table 1 by subjecting them to intermediate annealing and 60% cold rolling under the same conditions as in Example 1. For each steel type, two sheets of different thickness before cold rolling were used so as to obtain two types of cold-rolled sheets, one of about 1-mm thickness and the other of about 2-mm thickness, by cold rolling at the same reduction ratio of 60%. The cold-rolled sheets were finish-annealed and skin-pass rolled under various conditions, except that the finish annealing soaking period was kept constant at 60 sec. Property test samples were taken after finish annealing and after skin-pass rolling. The work-hardened stainless steel C1 was annealed and then cold-rolled at a reduction ratio of 50% to produce cold-rolled sheets of 2-mm and 1-mm thickness. A property test sample was taken from each cold-rolled sheet.

The property tests conducted were a tensile test using the 1-mm samples, a V-notch Charpy impact test using the 2-mm samples, and a spring bending elastic limit test using the 1-mm samples. The test specimens used in all tests were cut so that their longitudinal direction corresponded to the rolling direction. The tests were conducted at room temperature. In the spring bending elastic limit test, conducted in conformity with JIS H 3130, the value of spring bending elastic limit was calculated from the tester reading when the permanent deflection of a 10 mm×150 mm rectangular test specimen became 0.1 mm. The results are shown in Table 4.

TABLE 4

| | | | Finish-annealed steel sheet | | | | | | Skin-pass-rolled steel sheet | | | | | |
|---|---|---|---|---|---|---|---|---|---|---|---|---|---|---|
| | Test No | Steel No | Finish annealing soaking temperature (° C.) | 0.2% yield strength (N/mm$^2$) | Tensile strength (N/mm$^2$) | Elon-gation (%) | Charpy impact value (J/cm$^2$) | Spring bending elastic limit (N/mm$^2$) | Skin-pass rolling ratio (%) | 0.2% yield strength (N/mm$^2$) | Tensile strength (N/mm$^2$) | Elon-gation (%) | Charpy impact value (J/cm$^2$) | Spring bending elastic limit (N/mm$^2$) |
| Inv | X1 | A1 | 1010 | 830 | 1488 | 9.7 | 90 | 786 | 4.8 | 1470 | 1547 | 6.6 | 65 | 1405 |
| | X2 | | | | | | | | 9.3 | 1593 | 1624 | 5.1 | 54 | 1586 |
| | X3 | | 957 | 814 | 1467 | 8.5 | 83 | 757 | 5.0 | 1458 | 1531 | 5.8 | 56 | 1373 |
| | X4 | | 1045 | 832 | 1495 | 9.9 | 86 | 791 | 4.8 | 1486 | 1552 | 5.5 | 59 | 1406 |
| | X5 | A2 | 1023 | 814 | 1475 | 10.0 | 88 | 751 | 7.6 | 1548 | 1579 | 5.4 | 61 | 1485 |
| | X6 | A3 | 996 | 867 | 1514 | 8.3 | 84 | 765 | 3.7 | 1418 | 1483 | 7.0 | 70 | 1349 |
| | X7 | A4 | 1020 | 753 | 1539 | 7.2 | 76 | 692 | 5.5 | 1507 | 1585 | 5.6 | 54 | 1420 |
| | X8 | A5 | 1034 | 648 | 1414 | 10.4 | 99 | 523 | 4.2 | 1392 | 1491 | 7.8 | 72 | 1327 |
| | X9 | A6 | 989 | 841 | 1487 | 9.2 | 72 | 802 | 3.7 | 1383 | 1444 | 7.9 | 58 | 1319 |
| | X10 | A7 | 1011 | 832 | 1496 | 9.3 | 77 | 798 | 4.6 | 1471 | 1552 | 6.2 | 55 | 1412 |
| | X11 | A8 | 973 | 773 | 1422 | 9.7 | 98 | 689 | 8.1 | 1460 | 1528 | 6.1 | 59 | 1391 |
| Comp | Y1 | A1 | 1010 | 830 | 1488 | 9.7 | 90 | 786 | 11.4 | 1615 | 1657 | 4.6 | 49 | 1591 |
| | Y2 | | 939 | 798 | 1449 | 7.4 | 76 | 724 | 4.9 | 1439 | 1505 | 4.8 | 53 | 1338 |
| | Y3 | | 1068 | 826 | 1481 | 8.2 | 77 | 770 | 5.0 | 1456 | 1537 | 5.2 | 46 | 1394 |
| | Y4 | B4 | 992 | 720 | 1526 | 6.7 | 64 | 632 | 5.4 | 1531 | 1603 | 4.6 | 39 | 1462 |
| | Y5 | B6 | 1024 | 844 | 1485 | 9.2 | 78 | 773 | 8.7 | 1554 | 1610 | 5.4 | 45 | 1531 |
| | Y6 | B7 | 963 | 963 | 1548 | 6.5 | 62 | 842 | 4.4 | 1494 | 1574 | 4.3 | 36 | 1419 |
| | Y7 | B8 | 1034 | 576 | 1385 | 10.9 | 103 | 492 | 9.3 | 1519 | 1558 | 5.6 | 61 | 1447 |
| | Y8 | B9 | 1013 | 449 | 1303 | 14.2 | 136 | 407 | 9.5 | 1317 | 1436 | 8.3 | 73 | 1274 |
| | Y9 | C1 | — | — | — | — | — | — | (50) | 1422 | 1592 | 8.4 | 31 | 480 |

Remark:
Inv: Invention example
Comp: Comparative example.

As shown in Table 4, the steel sheets satisfying the chemical composition and production conditions stipulated by the invention (X1–X11), in their state following finish annealing, exhibited 0.2% yield strength of 640 N/mm$^2$ or greater, tensile strength of 1,400 N/mm$^2$ or greater, elongation of 7% or greater, Charpy impact value of 70 J/cm$^2$ or greater and spring bending elastic limit of 520 N/mm$^2$ or greater. After skin-pass rolling, they exhibited 0.2% yield strength of 1,380 N/mm$^2$ or greater, tensile strength of 1,400 N/mm$^2$ or greater, elongation of 5% or greater, Charpy impact value of 50 J/cm$^2$ or greater and spring bending elastic limit of 1,300 N/mm$^2$ or greater. They thus possessed a well-balanced combination of excellent strength, toughness and spring property characteristics. In contrast, the steel sheets satisfying the chemical composition, intermediate annealing and cold rolling conditions stipulated by the invention but whose finish annealing soaking temperature was outside the range specified by the invention (Y2, Y3) were inferior in ductility and toughness after skin-pass rolling. One skin-pass-rolled steel sheet (Y1) that satisfied the chemical composition, intermediate annealing conditions, cold rolling conditions and finish annealing conditions laid down by the invention but that was skin-pass-rolled at a reduction ratio exceeding 10% was low in ductility and toughness owing to excessive strengthening.

Looking next at the steel sheets produced from steels whose chemical compositions fell outside the invention range, Y4 (steel B4), which was high in C, and Y5 (steel B6) and Y6 (steel B7), which were high in B content, were low in ductility or toughness after skin-pass rolling, while Y7 (steel B8), which was high in Ni content, and Y8 (steel B9), which was high in Cr content, exhibited low strength or spring property after final annealing owing to a large amount of austenite after finish annealing.

EXAMPLE 4

Hot-rolled steel strips of 250-mm width and 3.0-mm thickness were produced by hot rolling 300-Kg steel ingots obtained by casting vacuum-melted steels of the chemical compositions shown in Table 5. In Table 5, A21–A30 are invention steels whose chemical compositions fall within the range specified by the invention. B21 is a comparative steel whose Ni content is outside the invention range. C1 (SUS301) shown in Table 1 was used as a conventional steel.

All steel strips other than C1 were subjected to not more than two cycles of intermediate annealing and cold rolling to obtain cold-rolled steel strips of 0.200–0.218 mm. The steel strips were finish-annealed at around 1,010° C. to obtain annealed steel strips. Some of the strips were further skin-pass-rolled. All of the annealed steel strips and skin-pass-rolled steel strips were adjusted to a thickness of 0.198–0.201 mm. As the conventional steel C1 was a work-hardened stainless steel, only it was subjected to cold rolling at a reduction ratio of 50% after annealing to obtain a 0.200-mm skin-pass-rolled steel strip. A 500-mm long steel sheet was cut from each annealed sheet strip and skin-pass-rolled sheet strip and examined for amount of residual austenite, amount of δ ferrite, amount of martensite, spring bending elastic limit, and tensile property.

Residual austenite amount was measured using a vibrating specimen type magnetometer. Measurement of δ ferrite amount was conducted by measuring the area ratios of δ ferrite observed in 20 L-section fields at 400 magnifications using an optical microscope and defining the average of the area ratios as the δ ferrite volume ratio. The volume ratio remaining after exclusion of residual austenite and δ ferrite was defined as martensite volume ratio.

The spring test specimens for all steels were fabricated as 13A test specimens in conformity with JIS Z 2201. The crosshead speed of the tensile tester was set at 3 mm/min and the test specimen was tensed until the nominal strain reached 0.1%. After load removal, an 80 mm×10 mm test piece was taken from the parallel portion and used for the spring test. The spring limit test was conducted with respect to the spring test specimen in conformity with the JIS H 3130 moment type test and the value of spring bending elastic limit was calculated from the tester reading when the permanent deflection became 0.1 mm. In this Example, the spring bending elastic limit is designated $Kb_{0.1}$. The spring test specimens and the tensile test specimens were cut so that their longitudinal direction corresponded to the rolling direction. The results are shown in Table 6.

TABLE 5

| Steel | Alloy components and content (mass percent) | | | | | | | | | | |
|---|---|---|---|---|---|---|---|---|---|---|---|
| No. | C | Si | Mn | P | S | Ni | Cr | N | B | Mo | Cu |
| A21 | 0.074 | 0.48 | 0.58 | 0.021 | 0.0018 | 4.12 | 15.80 | 0.069 | 0.0031 | — | — |
| A22 | 0.082 | 0.29 | 0.37 | 0.043 | 0.0034 | 3.76 | 16.20 | 0.053 | 0.0018 | — | — |
| A23 | 0.139 | 0.25 | 0.21 | 0.018 | 0.0009 | 2.95 | 16.62 | 0.049 | 0.0043 | — | — |
| A24 | 0.064 | 0.34 | 0.70 | 0.017 | 0.0013 | 4.85 | 16.38 | 0.051 | 0.0026 | — | — |
| A25 | 0.033 | 0.78 | 0.94 | 0.054 | 0.0051 | 3.66 | 14.09 | 0.095 | 0.0033 | — | — |
| A26 | 0.032 | 0.32 | 0.63 | 0.034 | 0.0027 | 4.92 | 14.82 | 0.034 | 0.0022 | — | — |
| A27 | 0.079 | 0.27 | 0.46 | 0.040 | 0.0028 | 3.63 | 16.36 | 0.059 | 0.0018 | — | — |
| A28 | 0.071 | 0.56 | 0.43 | 0.030 | 0.0009 | 3.98 | 14.63 | 0.072 | 0.0028 | 1.14 | — |
| A29 | 0.069 | 0.82 | 0.36 | 0.028 | 0.0022 | 2.84 | 15.91 | 0.068 | 0.0035 | — | 1.30 |
| A30 | 0.081 | 0.48 | 0.24 | 0.032 | 0.0016 | 2.79 | 15.01 | 0.071 | 0.0041 | 1.21 | 1.09 |
| B21 | 0.038 | 0.66 | 0.27 | 0.026 | 0.0023 | 5.45 | 15.26 | 0.063 | 0.0015 | — | — |

Remark:
A21–A30: Invention steels
B21: Comparative steel

TABLE 6

| | Test No | Steel No | Condition of tested steel | Skin-pass rolling reduction ratio (%) | Residual austenite amount (Vol %) | δ ferrite, amount (Vol %) | Martensite amount (Vol %) | Spring bending elastic limit $Kb_{0.1}$ ($N/mm^2$) | Uniform elongation (%) | Tensile strength ($N/mm^2$) |
|---|---|---|---|---|---|---|---|---|---|---|
| Inv | X21 | A21 | SP | 4.3 | 2.2 | 0 | 97.8 | 1060 | 1.9 | 1598 |
| | X22 | A21 | SP | 6.6 | 0 | 0 | 100 | 1130 | 0.5 | 1674 |
| | X23 | A22 | AN | — | 10.4 | 2.2 | 87.4 | 810 | 4.4 | 1509 |
| | X24 | A23 | SP | 2.7 | 11.3 | 0 | 88.7 | 972 | 3.4 | 1553 |
| | X25 | A24 | AN | — | 12.2 | 1.0 | 86.8 | 771 | 4.7 | 1495 |
| | X26 | A25 | AN | — | 2.6 | 0 | 97.4 | 877 | 3.8 | 1534 |
| | X27 | A28 | SP | 5.1 | 1.7 | 0 | 98.3 | 1092 | 1.6 | 1609 |
| | X28 | A29 | AN | — | 10.1 | 0 | 89.9 | 805 | 4.5 | 1520 |
| | X29 | A30 | SP | 4.3 | 2.9 | 0 | 97.1 | 1004 | 2.1 | 1603 |
| Comp | Y21 | A21 | SP | 7.9 | 0 | 0 | 100 | 1183 | 0.2 | 1757 |
| | Y22 | A23 | AN | — | 16.8 | 0 | 83.2 | 688 | 4.9 | 1468 |
| | Y23 | A26 | AN | — | 1.8 | 0 | 98.2 | 623 | 6.5 | 1410 |
| | Y24 | A27 | SP | 1.4 | 10.2 | 3.9 | 85.9 | 612 | 2.6 | 1518 |
| | Y25 | B21 | AN | — | 16.0 | 0 | 84.0 | 665 | 5.9 | 1453 |
| | Y26 | C1 | SP | 49.7 | 35.0 | 0 | 65.0 | 480 | 3.6 | 1592 |

Remark:
Inv: Invention steels
Comp: Comparative steels
SP: Skin-pass-rolled
AN: Annealed Gasket-shaped test specimens fabricated from the annealed steel sheets and skin-pass-rolled steel sheets of test numbers X21–X29 and Y21–Y26 shown in Table 6 were subjected to a fatigue test by repeated stress application. The steel sheets are identified as to whether annealed or skin-pass-rolled in the third column of Table 6. As shown in FIG. 1, each test specimen was prepared by first opening a 75-mm inner diameter round hole at the center of a square material sample cut 150 mm per side and then press-forming a 2.5-mm-wide, 0.25-mm-high bead around the rim near the hole to have a protrusion radius of 2 mm. Loads of up to 10 tons were applied to the test specimen 5 times to adjust the bead height to 60±1 μm. Then, starting from the unloaded state, a load was progressively applied to the bead and the load at which the bead height became 20±1 μm was noted and defined as the compression load. A higher compression load indicates greater elasticity of the bead portion and warrants a high rating as a gasket steel with excellent gas-sealing property. A fatigue test was conducted under application of this compressive load at an amplitude of ±1 kN and a vibration frequency of 40 times/min. When the number of repetitions reached 1 million, the beaded portion was observed with a microscope. The results of the fatigue test were evaluated as "Unfractured" if absolutely no microcracks were observed and as "Fractured" if any microcracks were observed, regardless of how few. In addition, resistance to permanent set property was evaluated based on the amount of permanent set defined as the value obtained by subtracting the bead height after the fatigue test from that before the test. The bead height was measured both before and after the test as the average value observed at three points using a focal microscope. The results are shown in Table 7.

TABLE 7

| | Test No. | Compressive load (ton) | Fatigue test result | Amount of parmanent set after fatigue test (μm) |
|---|---|---|---|---|
| Inv | X21 | 2.7 | Unfractured | 1 |
| | X22 | 2.8 | Unfractured | 0 |
| | X23 | 2.4 | Unfractured | 1 |
| | X24 | 2.5 | Unfractured | 1 |
| | X25 | 2.3 | Unfractured | 2 |
| | X26 | 2.5 | Unfractured | 1 |
| | X27 | 2.7 | Unfractured | 0 |
| | X28 | 2.4 | Unfractured | 1 |
| | X29 | 2.8 | Unfractured | 0 |
| Comp | Y21 | 2.9 | Fractured | 6 |
| | Y22 | 2.1 | Fractured | 8 |
| | Y23 | 1.7 | Unfractured | 5 |
| | Y24 | 2.0 | Unfractured | 7 |
| | Y25 | 2.2 | Fractured | 9 |
| | Y26 | 2.1 | Fractured | 6 |

Remark:
Inv: Invention example
Comp: Comparative example

As shown in Tables 6 and 7, even after 1 million repetitions of the compressive fatigue test, the steel sheets of tests X21–X29 produced in accordance with the invention experienced no breakage of the bead portion and had low permanent set amounts of no more than 2 μm. They were obviously excellent in fatigue property and resistance to permanent set. Owing to their high compressive loads, they were also excellent in gas-seal property.

In contrast, the steel sheet of comparative example Y21, despite being produced from an invention steel (A21), had tensile strength greater than 1,700 $N/mm^2$ and was low in ductility, because the skin-pass rolling reduction ratio was higher than that in invention examples X21 and X22. It also incurred microcracks and degradation of the resistance to permanent set in the fatigue test. The steel sheets of comparative examples Y22 and Y25 included such a large amount of austenite that their amounts of martensite fell below 85 vol %. They were therefore low in spring bending elastic limit and inferior to the invention examples in resistance to permanent set. As demonstrated by invention example X24, this problem can be overcome by conducting skin-pass rolling to convert part of the residual austenite to martensite. Low spring bending elastic limits of under 700 $N/mm^2$ and inferior resistance to permanent set were exhibited by the steel sheet of comparative example Y23, owing to relatively low C and N content, and the steel sheet of comparative example Y24, owing to large amount of δ ferrite. The steel sheet of Y26 prepared from conventional SUS301 steel did not attain the high level of resistance to permanent set achieved by the invention.

This invention provides a steel sheet falling within the category of a martensitic quench-hardened stainless steel that not only possesses high strength comparable to that of the work-hardened stainless steel SUS301 but also exhibits outstanding toughness and spring property. The invention further provides a method for reliable suppression of the edge cracking that becomes a problem with increasing steel hardness and, as such, eliminates the decrease in product yield caused by steel sheet edge trimming. Notwithstanding its excellent properties, therefore, the high-strength stainless steel sheet in accordance with the present invention is low in both raw material and production cost.

Moreover, by regulating metallic structure and mechanical properties within prescribed ranges, the present invention enables production of steel sheet for metal gaskets that exhibits excellent fatigue property and resistance to permanent set of a level unattainable heretofore.

What is claimed is:

1. A method of inhibiting cold-rolled steel sheet edge cracking of a high-strength, high-toughness martensitic stainless steel sheet, which method is applied with respect to a hot-rolled steel sheet of martensitic stainless steel having a chemical composition comprising, in mass percent, more than 0.03 to 0.15% of C, 0.2–2.0% of Si, not more than 1.0% of Mn, not more than 0.06% of P, not more than 0.006% of S, 2.0–5.0% of Ni, 14.0–17.0% of Cr, more than 0.03 to 0.10% of N, 0.0010–0.0070% of B, and the balance of Fe and unavoidable impurities and having an A value defined by Equation (1) of not less than −1.8:

$$\text{A value}=30(C+N)-1.5Si+0.5Mn+Ni-1.3Cr+11.8 \quad (1),$$

and comprises a step of subjecting the sheet to a single cycle or multiple repeated cycles of a process (intermediate annealing and cold rolling process) consisting of intermediate-annealing the sheet at a soaking temperature of 600–800° C. for a soaking period of not more than 10 hr to adjust steel hardness to Vickers hardness (Hv) of not greater than 380, followed by cold rolling.

2. A method of inhibiting cold-rolled steel sheet edge cracking of a high-strength, high-toughness martensitic stainless steel sheet according to claim 1, which method is applied with respect to a hot-rolled steel sheet of matensitic stainless steel having a chemical composition comprising, in mass percent, more than 0.03 to 0.15% of C, 0.2–2.0% of Si, not more than 1.0% of Mn, not more than 0.06% of P, not more than 0.006% of S, 2.0–5.0% of Ni, 14.0–17.0% of Cr, more than 0.03 to 0.10% of N, 0.0010–0.0070% of B, and the balance of Fe and unavoidable impurities and having an A value defined by Equation (1) of not less than −1.8:

$$\text{A value}=30(C+N)-1.5Si+0.5Mn+Ni-1.3Cr+11.8 \quad (1),$$

and comprises a step of subjecting the sheet to a single cycle or multiple repeated cycles of a process (intermediate annealing and cold rolling process) consisting of intermediate-annealing the sheet at a soaking temperature in the range of 600–800° C. and in a range of x (° C.) satisfying Z value≦380 in Equation (2):

$$\text{Z value}=61C-6Si-7Mn-1.3Ni-4Cr-36N-7.927\times10^{-6}x^3+1.854\times10^{-2}x^2-13.74x+3663 \quad (2),$$

for a soaking period of not more than 10 hr, followed by cold rolling.

3. A method of inhibiting cold-rolled steel sheet edge cracking according to claim 1 or 2, wherein the intermediate annealing soaking period in each cycle of the intermediate annealing and cold rolling process is not greater than 300 sec.

4. A method of inhibiting cold-rolled steel sheet edge cracking according to any of claims 1 to 3, wherein the cold rolling reduction ratio in each cycle of the intermediate annealing and cold rolling process is not greater than 85%.

5. A method of producing a high-strength, high-toughness martensitic stainless steel sheet while inhibiting cold-rolled steel sheet edge cracking, which method comprises subjecting a cold-rolled sheet produced according to and having undergone the intermediate annealing and cold rolling process of the method of any of claims 1 to 4 to finish annealing at a soaking temperature of 950–1,050° C. for a soaking period of not greater than 300 sec, without first subjecting it to trimming of edges at opposite lateral extremities.

6. A method according to claim 5, wherein skin-pass rolling is effected at a reduction ratio of 1–10% after the finish annealing.

* * * * *